US011746631B2

(12) United States Patent
Laing et al.

(10) Patent No.: US 11,746,631 B2
(45) Date of Patent: Sep. 5, 2023

(54) HORIZONTAL WELLBORE SEPARATION SYSTEM AND METHOD

(71) Applicant: Cleantek Industries Inc., Calgary (CA)

(72) Inventors: Eric Laing, Calgary (CA); Geoff Steele, Calgary (CA); Pawandeep Khaira, Calgary (CA); John Barrett, Calgary (CA); Mathew Barrett, Calgary (CA); Lowell Chapman, Calgary (CA)

(73) Assignee: Cleantek Industries, Inc., Calgary (CA)

( * ) Notice: Subject to any disclaimer, the term of this patent is extended or adjusted under 35 U.S.C. 154(b) by 49 days.

(21) Appl. No.: 16/978,484

(22) PCT Filed: Mar. 12, 2019

(86) PCT No.: PCT/CA2019/050301

§ 371 (c)(1),
(2) Date: Sep. 4, 2020

(87) PCT Pub. No.: WO2019/173909

PCT Pub. Date: Sep. 19, 2019

(65) Prior Publication Data

US 2021/0010354 A1 Jan. 14, 2021

Related U.S. Application Data

(60) Provisional application No. 62/641,886, filed on Mar. 12, 2018.

(51) Int. Cl.
*E21B 43/12* (2006.01)
*F04B 23/08* (2006.01)
(Continued)

(52) U.S. Cl.
CPC ..... *E21B 43/128* (2013.01); *F04B 23/08* (2013.01); *F04D 13/10* (2013.01); *F04D 13/12* (2013.01);
(Continued)

(58) Field of Classification Search
CPC ..... E21B 43/128; E21B 43/38; E21B 43/36; F04B 23/08; F04B 43/02; F04B 45/04;
(Continued)

(56) References Cited

U.S. PATENT DOCUMENTS 5,588,486 A * 12/1996 Heinrichs ..... B01D 19/0047 166/50
7,270,178 B2 * 9/2007 Selph ..... E21B 43/128 166/50
(Continued)

FOREIGN PATENT DOCUMENTS

CA 2953157 A1 12/2015

OTHER PUBLICATIONS

International Search Report in International Application No. PCT/CA2019/050301, dated May 15, 2019.
(Continued)

*Primary Examiner* — Daniel P Stephenson
(74) *Attorney, Agent, or Firm* — Greenblum & Bernstein, P.L.C.

(57) ABSTRACT

A flow management and separation system for a wellbore having a horizontal section, vertical section and intermediate build section, a production tubing, and an annulus surrounding the production tubing, is combined with a primary vertical lift device disposed in the intermediate build section or a heel segment of the horizontal section. The fluid flow management system may be located adjacent to and downhole from the primary vertical lift device. The system includes an intake to an intake passage, to receive produced
(Continued)

fluids from the reservoir; a wavebreaker for calming produced fluid flow; a fluidseeker having a rotatable inlet extension having a weighted keel and an internal bypass passage in fluid communication with the intake flow passage; and a separator for separating gas and liquid phases uphole from the fluidseeker.

20 Claims, 9 Drawing Sheets

(51) Int. Cl.

| | |
|---|---|
| ***F04D 13/10*** | (2006.01) |
| ***F04D 13/12*** | (2006.01) |
| ***F04F 1/20*** | (2006.01) |
| *F04F 5/54* | (2006.01) |
| *F04B 43/02* | (2006.01) |
| *F04B 45/04* | (2006.01) |

(52) U.S. Cl.
CPC ..... *F04F 1/20* (2013.01); *F04B 43/02* (2013.01); *F04B 45/04* (2013.01); *F04F 5/54* (2013.01)

(58) Field of Classification Search
CPC ..... F04B 47/06; F04D 13/10; F04D 13/12; F04D 9/006; F04D 29/4273; F04F 1/20; F04F 5/54; F04F 5/12; F04C 2/107
See application file for complete search history.

(56) References Cited

U.S. PATENT DOCUMENTS

| | | | | |
|---|---|---|---|---|
| 10,920,560 | B2 * | 2/2021 | Raglin | E21B 43/121 |
| 11,162,338 | B2 * | 11/2021 | Brown | E21B 47/008 |
| 11,299,973 | B2 * | 4/2022 | Brown | E21B 43/128 |
| 2001/0004017 | A1 * | 6/2001 | Lopes | E21B 43/38 96/204 |
| 2013/0037261 | A1 | 2/2013 | Duphorne | |
| 2014/0341755 | A1 * | 11/2014 | Laing | F04B 47/06 417/474 |
| 2016/0281486 | A1 * | 9/2016 | Obrejanu | E21B 43/121 |
| 2021/0010354 | A1 * | 1/2021 | Laing | F04D 9/006 |
| 2022/0195859 | A1 * | 6/2022 | Laing | B01D 19/0042 |

OTHER PUBLICATIONS

Written Opinion in International Application No. PCT/CA2019/050301, dated May 15, 2019.

* cited by examiner

SECTION B-B

SECTION A-A

HORIZONTAL WELLBORE SEPARATION SYSTEM AND METHOD

FIELD OF THE INVENTION

The present invention relates to a well fluid separation system and method for producing fluids from a wellbore having a vertical section, a horizontal section and an intermediate build section.

BACKGROUND

It is well known in the art of oil and gas production to use pumps landed in the deepest point of a vertically oriented wellbore, or any section of a lined, perforated, open hole or fracture stimulated horizontal wellbore, to lift produced liquids from the reservoir to surface. Traditional vertical artificial lift solutions are well known. Various mechanical pumps such as rod pumps, progressive cavity pumps, electric submersible pumps or hydraulically actuated pumps are in widespread use in the oil and gas industry.

There are many benefits to utilizing a horizontal drilling and completions strategy for completing and producing wellbores. A horizontal wellbore can increase the exposure of the reservoir by creating a hole which follows the reservoir thickness. A typical horizontal wellbore plan also allows for the wellbore trajectory to transversely intersect the natural fracture planes of the reservoir and thereby increase the efficiency of fracture stimulation and proppant placement and therefore total productivity.

The primary advantage of a horizontally oriented wellbore is the exposure of a greater segment of the reservoir to the wellbore using a single vertical parent borehole than is possible using several vertical wellbores drilled into the same reservoir. Using multiple horizontal boreholes exiting from a single vertical wellbore in a multilateral well may increase the advantage. However, in order to maximize this advantage, well performance must be proportional to the exposed length of reservoir in the producing well. As is commonly known in the industry, the relationship of well exposure to well productivity is not directly proportional in horizontally oriented wellbores.

Generally, the production of horizontal wellbores is exploited using reservoir energy until the initial production is obtained. The vast majority of horizontal wellbores are now stimulated with horizontal multi-stage fracturing systems to increase the exposure of the reservoir to the horizontally oriented wellbore. However, this stimulation technique only finitely energizes the reservoir, with the pressure returning quickly to the original in-situ reservoir pressure. If the reservoir drive is insufficient or quickly dwindles, production from the horizontal segment of the wellbore is drawn down utilizing a single pump inlet landed at or near the heel of the horizontal wellbore. Alternately, other conventionally known lift solutions such as plunger lift and gas lift are used to manage the back pressure on the formation through the vertical and build section of the wellbore. Other services such as jet pumps are used in an intermittent capacity to unload or clean out the horizontal wellbore section.

Conventional artificial lift means for producing a horizontal well do not influence the reservoir much past the heel of the wellbore, resulting in heel-preferential depletion where drawdown is localized to the region in the heel.

The drawdown pressure is also limited to the theoretical vapor pressure of the fluid being pumped. A producing oil well, either horizontal or vertical, transitions through its bubble point during its producing life. When this occurs, gas escapes from solution and there exists at least two separate phases (gas and oil) in the reservoir, resulting in a gas cap drive. The efficient production of these types of reservoirs may be accomplished by carefully managing the depletion of the gas cap drive, which may be monitored by the produced gas/liquid ratios. In a traditional free-flowing gas cap drive well, the fluids will be mobilized by the gas drive and follow the path of least resistance in the journey towards the surface. Again, this results in a disproportionate production of the reservoir in the vicinity of the heel of the wellbore. The onset of premature depletion at the heel is exacerbated by the single drawdown location in the wellbore located near the heel. This production regime is present throughout the producing life until such a time as the heel becomes depleted and the gas cap drive breaks through near the heel. Gas cap drive breakthrough will result in elevated gas/liquid ratios. This can result in gas locking and fluid pounding, overheating, fluctuating torques, increased slippage (plunger/barrel or rotor/stator) and lower pumping efficiency, which can lead to significant damage to the vertical pumping solution. Eventually the gas drive will deplete, leaving unproduced fluid (reserves) in the reservoir space, thus leading to low recovery factors and stranded oil in the reservoir.

It is well known in the art that the efficiencies of pumping systems landed at or near the heel of the horizontal portion of a wellbore can be very poor. The poor efficiencies manifest in the build section of the wellbore and are the result of the disorganized nature of the flow as the wellbore transitions from substantially horizontal to substantially vertical in orientation. This disorganized flow condition results in various phases being present in the vicinity of the pump system intake for varying lengths of time, resulting in the pump ingesting different phases over an extended period of time. This condition is related to the industry practice of positioning the intake for any lift system above the perforations in the horizontal portion of the wellbore. A pumping system positioned some vertical distance above the producing perforations will have a finite operating life. The dynamic fluid level in the wellbore will eventually reside below the intake to the pumping system. As such the pump will ultimately ingest only gas phases from the annulus in the wellbore leading to very poor overall pumping efficiency.

The complexity of such flow regimes within the wellbore can present falsely as a fluid level in the annulus, leading the well operator to believe that the pumping system has malfunctioned. In fact, as the flow transits the build portion of the wellbore and the various phases exchange dominance, the flow at each of the sections (nodes) transiting the measured wellbore length will appear very differently. This can manifest, for example, as "pockets" of gas traveling along the measured wellbore length and despite the presence of a "static" fluid level above will negatively impact the pumping system performance. The time period of which poor performance may vary and be influenced by a variety of criteria including, but not limited to, gas to liquid ratios, wellbore geometry, wellbore pressure, inclination and azimuth of the wellbore horizontal and build sections.

There remains a need for a separation system to remove liquids from wellbores of different geometries, including horizontal segments, which addresses hydraulic issues that pertain to these types of wells.

This background information is provided for the purpose of making known information believed by the applicant to be of possible relevance to the present invention. No admission is necessarily intended, nor should be construed, that any of the preceding information constitutes prior art against the present invention.

SUMMARY OF THE INVENTION

In general terms, the present invention comprises a system and method for fluid flow management integral to the tubing and located upstream (downhole) of a vertical lift pump.

Embodiments of the system and method of the present invention may be applied in conjunction with unconventional or enhanced oil recovery techniques, such as steam-assisted gravity drainage, miscible flood, steam (continuous or cyclic), gas or water injection. Embodiments of the system and method of the present invention may also be used in off-shore situations, including where the well head is located on the sea bed.

Phase separation has been previously addressed conventionally with oil and gas separators landed above the transitional build section of the wellbore to manage separation before entering the vertical lift solution conventionally disposed above the build section. The present invention generally relates to the development of a purely horizontal wellbore separator for use in the applications downhole of the build section where liquid/gas phases are separated before entering the build section of the wellbore.

In one aspect, the invention may comprise a flow management and separation system for a wellbore having a horizontal section, vertical section and intermediate build section, a production tubing, an annulus surrounding the production tubing, a primary artificial lift device having an intake and an outlet into the production tubing, the system comprising:

(a) an intake to an intake passage, to receive produced fluids from the reservoir;

(b) a wavebreaker presenting a narrowed annular cross-section and defining the intake flow passage; and (c) a fluidseeker comprising an axially rotatable inlet extension having a weighted keel, in fluid communication with a central internal passage, and an internal bypass passage in fluid communication with the intake flow passage.

In some embodiments, the system further comprises a separator having a perforated housing and an internal recovery flow tube defining a separation space between them, wherein the recovery flow tube receives fluid from the central internal passage of the fluidseeker, and the separation space receives fluid from the bypass passage of the fluid seeker, and wherein the recovery flow tube is connected to the primary artificial lift intake.

In some embodiments, the wavebreaker comprises a removable section and a castellated body for positioning an open section to accommodate the passage of external capillary lines and/or electrical conduits along the exterior length of the flow conditioning system. The capillary lines may be employed to inject chemicals, for example inhibitors, at the system intake for management of scale or wax which may be present in the producing wellbore.

In some embodiments, the body of the wavebreaker is constructed with materials with sufficient flexural strength to permit being compressed by contact with the wellbore casing.

In some embodiments, the fluid flow management system may be equipped with a clutch on the distal end of the assembly for aligning the open section of the wavebreaker with the path of the external capillary line(s) and/or electrical conduits.

A fluid flow management system may be deployed below any artificial lift system well known in the art, or otherwise, including but not limited to: diaphragm pumps, electric submersible pumps, hydraulic submersible pumps, jet pumps, pneumatic drive pumps, gas lift, chamber lift, plunger lift, gear pump, progressive cavity pump, vane pump or any combination thereof.

In some embodiments, the fluid flow management system may be deployed into a wellbore and provide fluid conditioning for fluids entering the intake of an insert type high angle reciprocating pump landed immediately adjacent to the system on the proximal end. In other embodiments, the fluid flow management system may be deployed distally to an electric submersible progressive cavity pump to provide flow conditioning for the fluids entering the intake of the electric submersible pump.

In one embodiment, the fluid flow management system may be deployed with tubing adjacent to and below the system wherein the tubing is equipped with pressure and/or temperature gauges and memory packs or surface read out data acquisition equipment. The purpose of this sensor string being to monitor conditions along the length of the wellbore and acquire data. The acquired data may permit assessing the contribution of fracture points and providing insight into the potential location of and potential productivity improvements associated with locating horizontal pumps in strategic positions along the horizontal length spanning from the heel to the toe of the wellbore.

In another aspect, the invention may comprise a method of producing a well having a vertical, build and horizontal sections, and comprising a production tubing and a lining, casing or reservoir face defining an annulus, the method comprising the steps of:

(a) landing a primary artificial lift system in the build section or a heel portion of the horizontal section, with a fluid flow management system operative to calm annular mixed phase flow, provide retention time to encourage liquid dropout to a lower section of the annulus, and comprising a rotatable gravity directed inlet extension oriented in the lower section of the annulus, wherein the inlet extension is connected to an intake for the primary artificial lift system; and (b) operating the primary artificial lift system to lift fluids through the inlet extension.

In some embodiments, the method may further comprise the step of collecting wellbore data from downhole locations and processing the data to (a) control operation of the primary artificial lift and/or the fluid flow management system, (b) plan or configure a horizontal pumping system, and/or (c) plan a stimulation fracturing scheme.

BRIEF DESCRIPTION OF THE DRAWINGS

In the drawings, like elements are assigned like reference numerals. The drawings are not necessarily to scale, with the emphasis instead placed upon the principles of the present invention. Additionally, each of the embodiments depicted are but one of a number of possible arrangements utilizing the fundamental concepts of the present invention. The drawings are briefly described as follows.

With an alternative embodiment of the wavebreaker a single solid body is energized by a designed interference fitment with the inside diameter of the well casing.

Figure 6B:
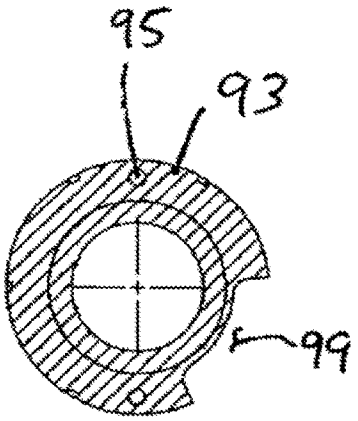
Figure 6A:
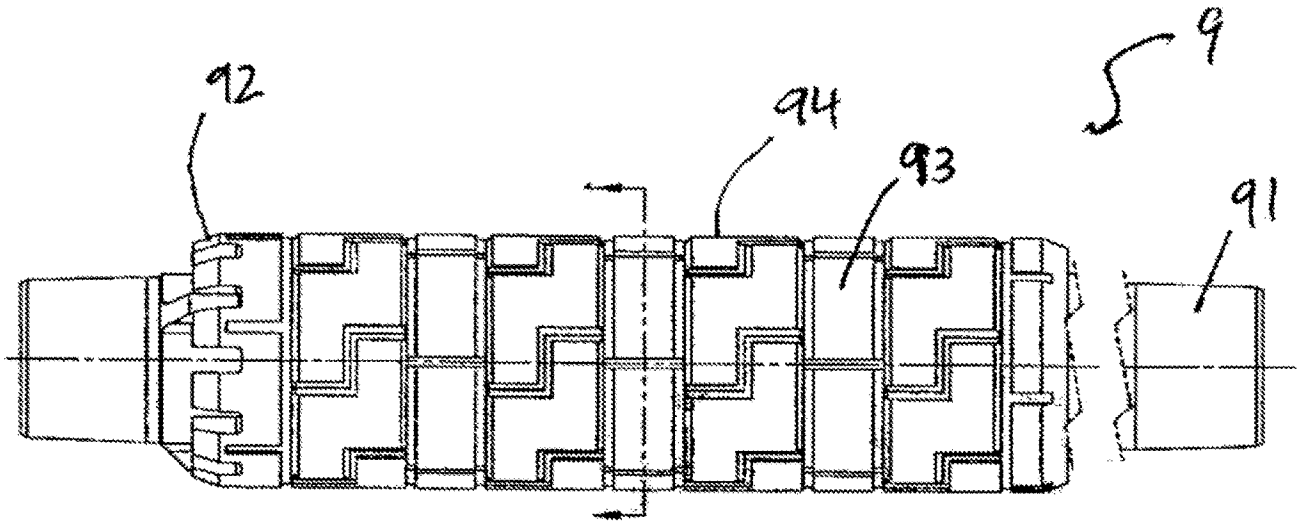
Figure 6C:
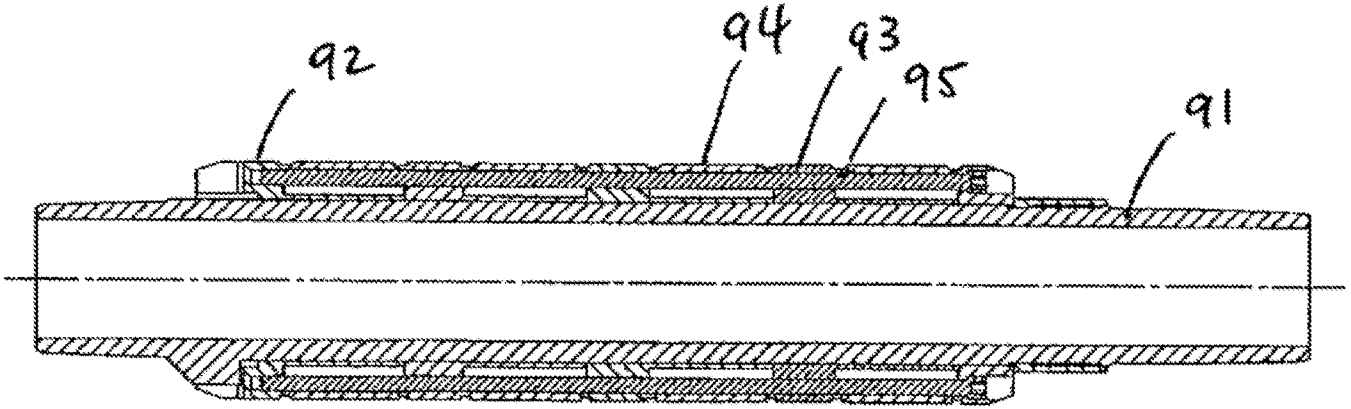

FIG. 6A depicts a secondary wavebreaker device. FIG. 6B is a transverse cross-section along the line A-A in FIG. 6A. This transverse section reveals the removable section allowing the passage of capillary lines external to the fluid flow management system. Each block section of the slug mitigation device is spring loaded to ensure the mechanism remains coincident with the internal diameter (ID) surface of the casing/liner, while facilitating installation into the casing/liner. FIG. 6C is a longitudinal cross-section of FIG. 6A.

Figure 7:
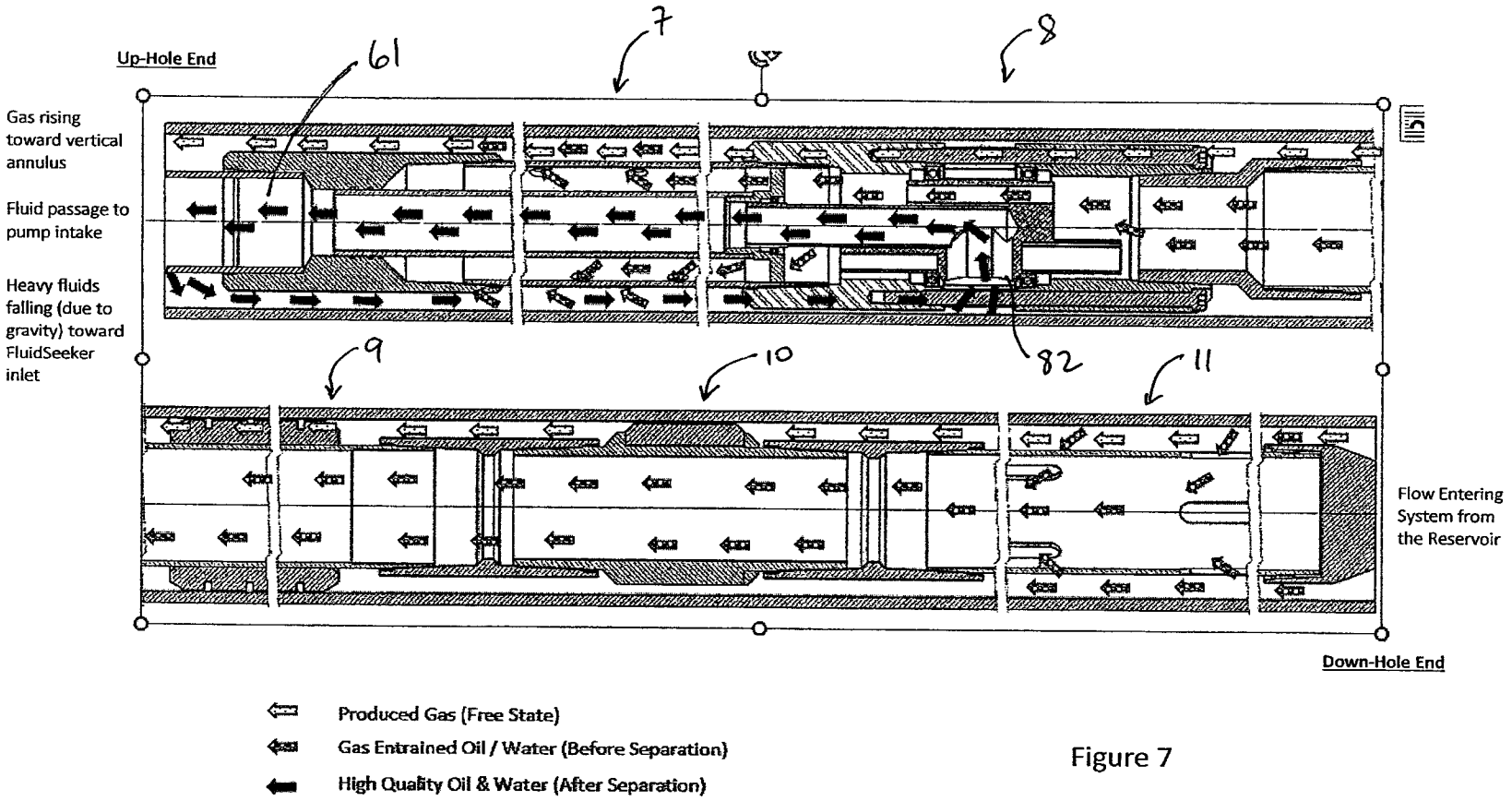

FIG. 7 shows the fluid flow management system and the multiple flow paths for the multi-phase production through the system. The legend on the figure details the types of fluid and the arrow image associated with each.

Figures 8A, 8B, 8C:
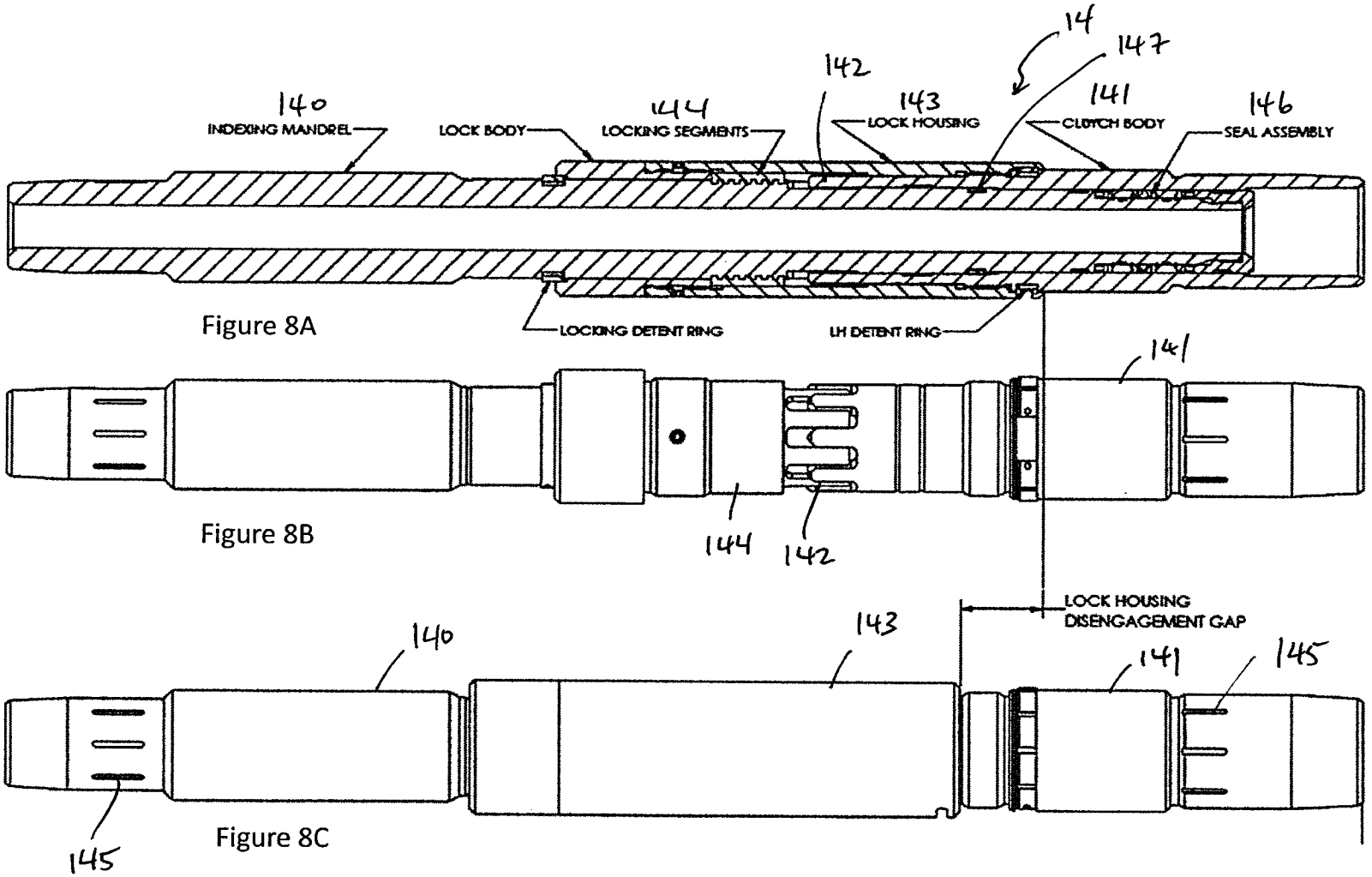

FIG. 8A shows a longitudinal cross section of the releasable, rotatable sealed tubing clutch in the fully locked state in which state the pumping/production operations may commence.

FIG. 8B shows a longitudinal outer view of FIG. 8A, from which the lock housing has been removed in order to show the castellations between the indexing mandrel and clutch in the locked condition, the castellations have the principal purpose of preventing rotation between the same.

FIG. 8C shows a longitudinal outer side view of the same clutch assembly in the locked state but wherein the locking housing is threadingly dis-engaged from the clutch body thereby exposing the lock housing detent ring and the clutch body thread.

Figures 8D, 8E:
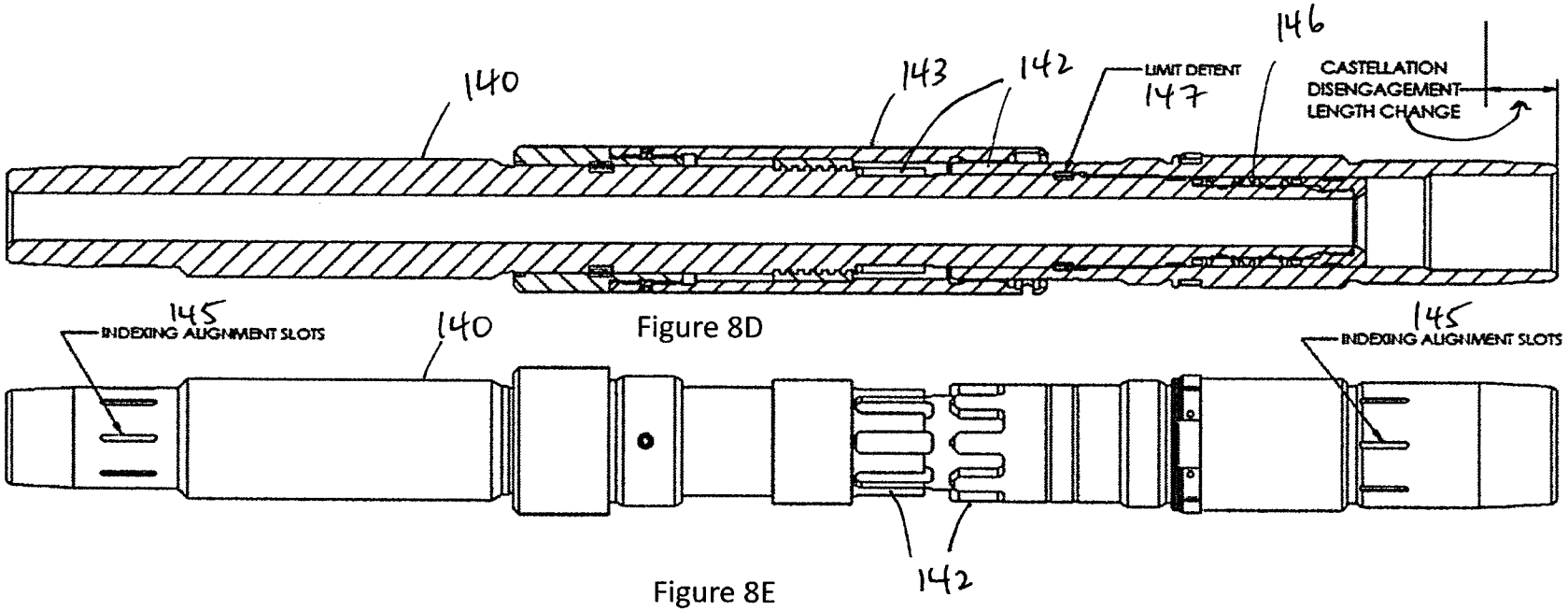

FIG. 8D shows a longitudinal cross section of the clutch assembly in the fully disengaged operable to permit rotation of the pump assembly with respect to the fixed tubing element threadingly engaged with the clutch body.

FIG. 8E shows the same clutch positional assembly from FIG. 8D but with the lock housing removed thereby exposing the castellations in their fully disengaged position.

DETAILED DESCRIPTION OF PREFERRED EMBODIMENTS

Figure 1:
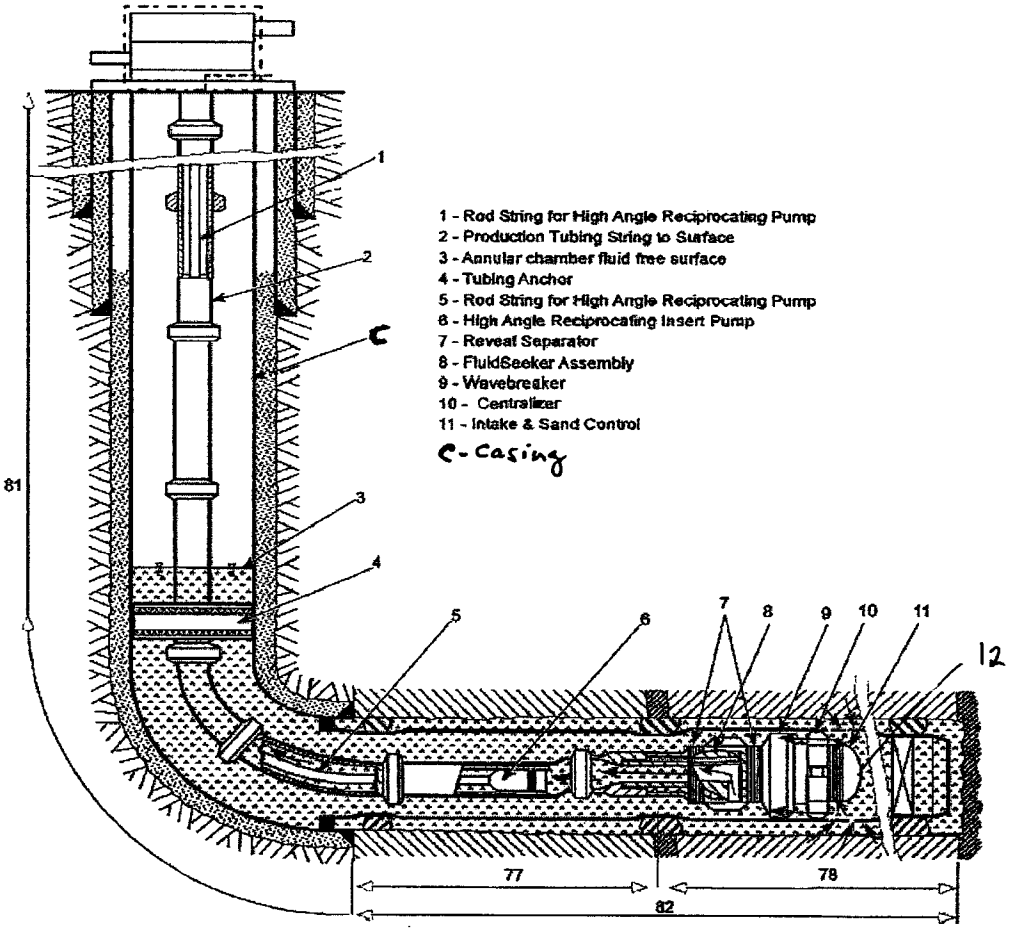
FIG. 1 shows a schematic representation of a wellbore having a vertical section, transitional (build) section, and a horizontal section. This figure shows a high angle rod pump landed horizontally just beyond the build section, and the fluid flow management system in the horizontal wellbore, distally adjacent to the pump.

In general terms, the invention comprises a fluid flow management system which enhances gas/liquid separation and production to the surface, and relates to methods and systems for producing fluids from wellbores having a vertical section, a horizontal section, and an intermediate build section, as schematically depicted in FIG. 1.

As used herein, the terms "distal" and "proximal" are used to describe the relative positioning of elements relative to surface equipment, where the distal end of components is farther downhole, away from the surface, while the proximal end is uphole, closer to the surface, regardless of vertical or horizontal orientation.

As used herein, the term "fluid" is used in its conventional sense and comprises gases and liquids.

The physics of production flow in each of the vertical section and horizontal section are different. The vertical section of the wellbore requires relatively higher horsepower because of the need to propel liquids up a vertical distance. The horizontal length and build section of the wellbore presents a fluid transportation problem over horizontal distances, with much lower head requirements and therefore much lower nominal horsepower requirements. In general, the fluid flow management system described herein is configured to create calm fluid conditions in the heel portion of the wellbore. This calm flow is a consequence of the gravity separation and retention time permitted to continue in isolation in the heel segment and through the transitional section of the wellbore, by the placement of the separator at the distal end of the substantially depleted region near the heel of the wellbore. Fluid slugging in this region can be prevalent, resulting in a downgraded pumping system performance. Embodiments of the invention may be employed to mitigate against fluid slugging and disorganized fluid flow. Slugging may be mitigated in this region by the action of the wavebreaker, which serves to de-energize the flow from the reservoir impinging on the distal end of the horizontally oriented separator system.

In general terms, fluid flow management systems described herein may be combined with any vertical artificial lift solution, including without limitation a reciprocating rod pump, a diaphragm pump, an electric submersible pump, a hydraulic submersible pump, a jet pump, a pneumatic drive pump, a gas lift pump, a gear pump, a progressive cavity pump, a vane pump or combinations thereof.

In one embodiment, the vertical lift pump is a high angle reciprocating rod pump, which operates in a conventional manner, but may include adaptations which permit its use at more horizontal orientations, and even completely horizontal. In one embodiment, the high-angle rod pump may be landed just below the build section, in the heel of the horizontal section, adjacent to, and above the fluid flow management system. Examples of such a pump are described in co-owned U.S. patent application Ser. No. 15/321,140 entitled "Rod Pump System", the entire contents of which are incorporated herein by reference, where permitted. In one embodiment, the invention comprises a fluid flow management system for treating a multi-phase fluid stream to produce a liquid stream for a pump intake, comprising: (a) an intake section with optional sand control media; (b) an annular slug mitigation device (referred to herein as a wavebreaker) adjacent to and proximally located from a centralizer device to direct the well fluids towards the separator internals; and (c) a gravity assisted intake (referred to herein as a fluidseeker) which self-orients downwards, to increase the probability of the intake being immersed in a liquid.

The components comprising this fluid flow system work in concert to organize fluid flow leading up to the transitional (build) section. In preferred embodiments, the system may further comprise at least one baffle plate for normalizing the flow conditions of the multi-phase stream in preparation for phase separation; at least one separation chamber; and at least one perforated pipe interval configured to allow gases to escape to the wellbore annulus.

In some embodiments, as shown schematically in FIG. 1, a rod string (1) reciprocates within the production tubing (2), which is concentrically placed in the well casing (C), creating an annular space between the tubing (2) and the casing (C) in the vertical section. A tubing anchor (4) places the tubing (2) in the wellbore in tension, however does not isolate the annular space above and below the tubing anchor (4). Thus any fluid produced in the annular space is free to migrate upwards, past the tubing anchor (4). The rod string (1) continues in the build section (5) and actuates the rod pump (6), landed in the horizontal section production tubing (2). A perforated liner may hang from the casing and extend through the horizontal section of the wellbore. The liner and/or casing may be cemented and/or perforated. The liner and/or casing may incorporate fracture stimulation sleeves or other devices to direct fracture stimulation treatment fluids and proppants. Alternatively, the wellbore completion may be of an open hole structure.

In some embodiments, the fluid flow management system comprises a gas/liquid separator (7), a fluidseeker (8), and a wavebreaker (9). The distal end of the assembly may include a centralizer (10) which positions the assembly within the liner, and an intake (11) which may comprise sand control, equipped with a bull plug (15) to direct reservoir fluids through the primary system intake/sand control assembly (11).

The wavebreaker (9) serves to calm the fluid or reduce velocity of the fluid in the annular space, and is installed proximal to the primary system intake (11). The wavebreaker defines a central fluid passage which is in fluid communication with the intake (11), and the fluidseeker (8). The exterior of the wavebreaker (9) is configured to restrict fluid flowing around the wavebreaker. In some embodiments, the wavebreaker comprises a plurality of radially arrayed individual blocks (94), some or all of which are spring loaded to be biased radially outward such that the face of each block contacts the casing/liner pipe inside diameter (ID). The radial bias allows the wavebreaker to be installed through smaller diameter joints and irregularities. However, even as these blocks contact the pipe ID, no seal is created. The blocks (94) are separated by bypass grooves to permit relatively free gas passage around the wavebreaker (9). The reduced annular space surrounding the wavebreaker (9) de-energizes any fluid slugs moving toward the heel which encounter the wavebreaker, and thus encourages fluids to enter the body of the separation system through the primary intake (11) downhole from the wavebreaker.

An alternate embodiment of the wavebreaker (9) device contains a single piece wavebreaker body formed from a material with sufficient flexural strength to permit designed interference fitment with a proposed casing inside diameter or other lesser diameter devices including but not limited to fracture sleeves, ball seats or the like. The material may compress upon contact with the casing or liner inner diameter. The exterior of the wavebreaker still configures blocks (94) separated by gaps permitting fluid passage. Such a fitment ensures fluid slugs are de-energized while allowing at least the free state gas to bypass the device between the solid body blocks (94).

Figure 2:
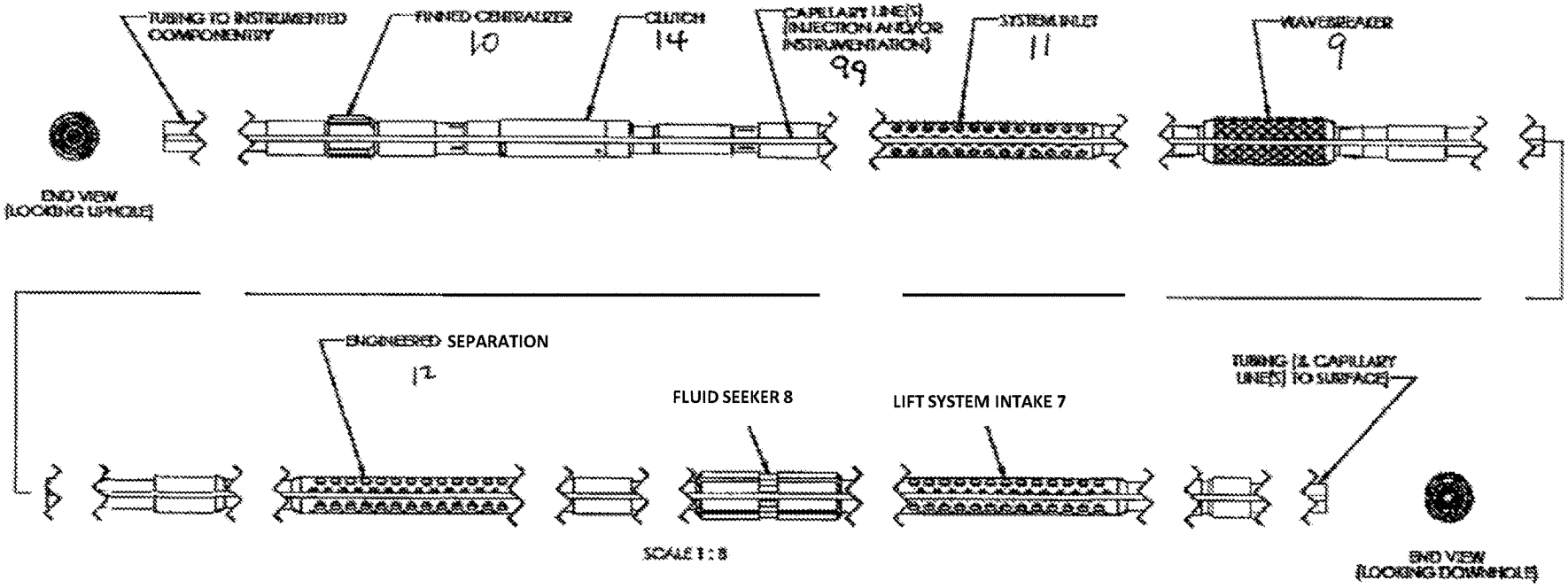
FIG. 2 shows components of a pumping system of one embodiment. Depicted in this embodiment is a clutch on the distal end of the system and a single external capillary line transiting the length of the system.
Figure 3C:
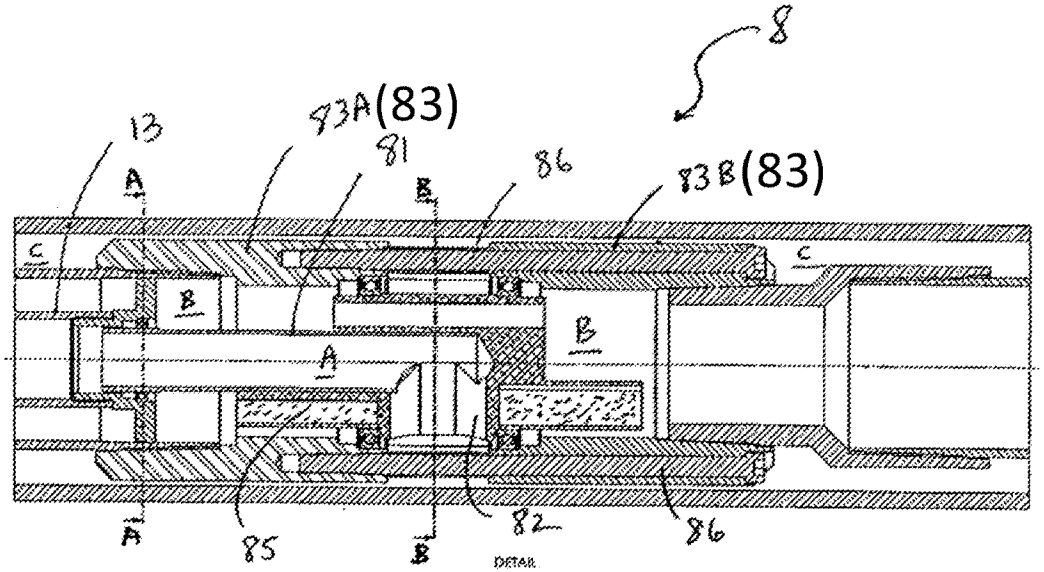
FIG. 3C is a longitudinal cross-section of the fluidseeker and is a detailed view of a portion of FIG. 3D, which is a longitudinal cross section through the fluid flow management system.
Figure 3B:
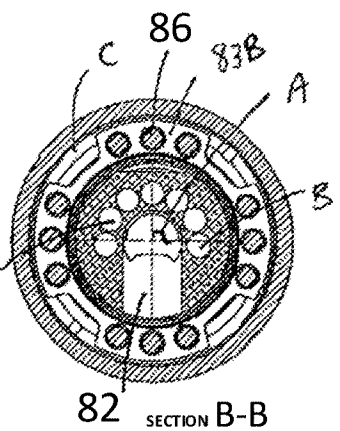
FIGS. 3A-B are transverse cross-sections of a fluidseeker.
Figure 3A:
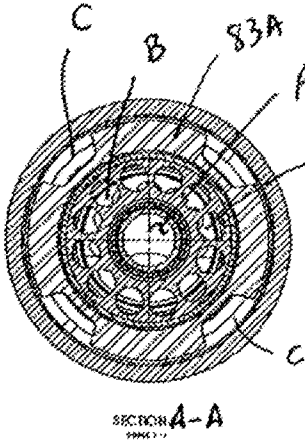
Figure 3D:
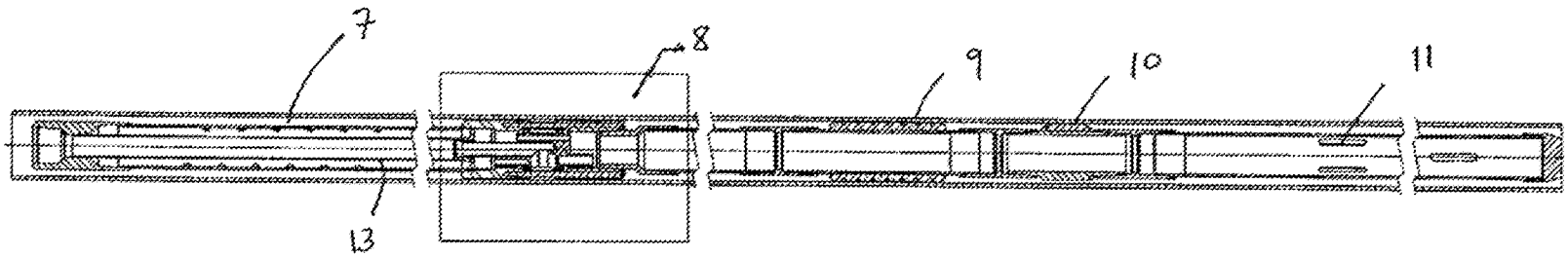

Fluids which enter the intake (11) travel through a continuous internal passage through the wavebreaker (9) and then the flow modulator section (12), which provide opportunity for additional separation, and may optionally provide perforations to allow separated gas to migrate to the annulus, as shown in FIG. 2. The purpose of the flow modulator section (12) is to continue to calm gas flow in the annulus. The calming effect may be enhanced by increased length of this section. Internal flow passes through the flow modulator section (12) and enters and flows through bypass ports of the fluidseeker.

If the flow modulator section (12) between the wavebreaker and the fluidseeker does not include the optional perforations shown in FIG. 2, the relatively higher velocity mixed phase flows through bypass passages in the fluidseeker and exits to the annulus downstream of the fluidseeker. This mixed phase flow then continues in the annulus through the build section of the wellbore undergoing retention time and separation. It is this mechanism which ensures the design of the flow modulator section (12) is independent of velocity (e.g. Reynolds Number) of the flow. This configuration ensures that separation is occurring in the annulus of the wellbore and downstream of the fluidseeker intake, while permitting gravity separation of the phases and allowing the high quality fluid to move downhole toward the fluidseeker where it is picked up for delivery into the system pump intake.

The fluidseeker (8) defines an internal passage for produced fluids which leads eventually to the vertical pump intake, and bypass passages for mixed-phase flow while allowing for gas migration to the annulus, and a liquid intake which permits pickup of liquids which settle in a lower portion of the annular space, as a result of the retention and separation of phases in the annulus.

In some embodiments, as shown in FIGS. 3A-D, the fluidseeker (8) comprises:

(a) an inner conduit (81) defining a central fluid passage (A) in fluid communication with the inner passage of a recovery flow tube (13) extending distally from the fluidseeker, and having an inlet extension (82) open to a lower half of the annulus between the production tubing and the liner or casing; and (b) a cylindrical outer housing (83) which defines an internal intermediate fluid bypass passage (B) which includes bypass ports.

The external fluid passage (C) is the annulus which passes around the fluid seeker (7). This configuration of the fluidseeker (8) only provides a downward facing inlet, and does not provide a passthrough central fluid passage for receiving produced liquids from the wellbore downhole of the system.

The inner conduit (81) is rotatably supported within the housing with a suitable bearing configuration and includes a weighted keel (85) axially aligned with the inlet extension (82). As a result, when placed horizontally, the inlet extension (82) will be oriented downwards by gravity. If the annulus between the fluidseeker (8) and the liner or casing is partially filled with liquid, the inlet extension (82) is thus more likely to be immersed in the liquid. The inlet extension (82) may optionally include a check valve (not shown) to ensure one-way flow of fluids into the central fluid passage (A).

In one embodiment, the outer housing (83) is comprised of a proximal housing (83A) and a distal housing (83B), bolted together with a plurality of elongate bolts (86).

In some embodiments, the system may comprise intake float (not shown) disposed on the rotatable inlet extension (82), with a level switch (not shown) operably connected to a pump activation system. Because the rotatable inlet extension (82) is always oriented vertically, the intake float may be configured to activate the level switch to initiate pumping when the intake float indicates a sufficient liquid level present in the inlet chamber, ensuring that the fluidseeker inlet extension (82) is immersed in liquid, and cease pumping when the level switch indicates that the liquid level has fallen below a specified operable lower limit.

Figure 4:
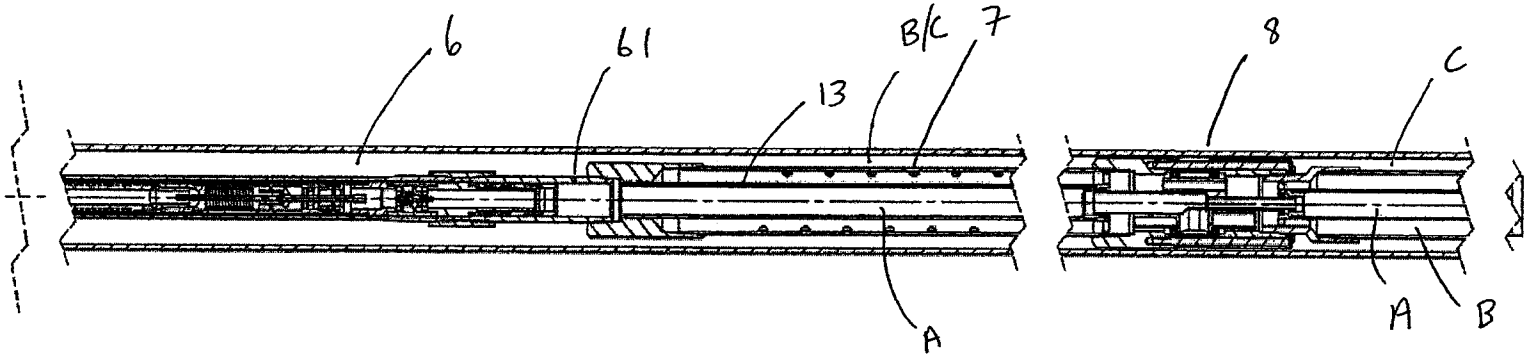
FIG. 4 shows a detailed longitudinal cross-section of an intake for the high angle lift pump, a recovery flow tube internal to a perforated separator body and the fluidseeker in isolated communication with the recovery flow tube.

As shown in FIG. 4, in some embodiments, the fluidseeker (8) is positioned immediately downhole of the rod pump (6) and receives high quality liquid flow (A) from the primary inlet (11) or from downhole horizontal pumps (not shown), and combines the high quality flow (A) with intake from the downward facing fluidseeker inlet extension (82). As with other embodiments, a mixed phase flows in intermediate flow bypass passages. Both the high quality liquid flow and the mixed phase intermediate flow pass into the gas/liquid separator (7), which comprises a central flow tube (71) and a perforated outer housing (72). The recovery flow tube (13) carrying the high quality liquid flow (A) leads directly into the rod pump intake (61), while fluids flowing in the intermediate passage (B) flows next into the small annulus between the recovery flow tube (13) and the perforated separator housing (72). In this separator section (7), the multi-phase liquids in this intermediate passage (B) may exit into the annulus. Gases will preferentially flow out into the annulus (C), while liquids will fall out and settle into the lower portion of the annulus. The gases and liquids will be retained in the annulus where they will remain for some retention time to facilitate phase separation.

The annular space primarily has relatively calm, lower velocity fluid flow, as a result of the distal action of the wavebreaker (9). This leads to the liquid accumulation in the lower portion of the annulus, which may be picked up by the downward facing inlet extension (82) of the fluidseeker (8).

The allowed retention time in the annular space may be designed or optimized in the system using well production parameters and a computational fluid dynamics model representing the anticipated or measured flow rates and gas-liquid ratios in the wellbore. For example, an increased length of separator segment (7) may provide increased retention time in this area.

In the wellbore annulus, gas passes through or around the tubing anchor (4) and is permitted to rise towards the surface. Any liquids retained in the gas may continue to condense or coalesce, and fall downhole by way of gravity separation and by virtue of the retention time in the annulus. As described above, the fluidseeker inlet extension (82) is facing the annulus and with its weighted keel is eccentrically oriented towards the bottom of the well. If the annulus is at least partly filled with liquid, this intake will likely be submerged in liquid. The fluidseeker inlet extension (82) leads directly to the central flow passage of the recovery flow tube (13) and ultimately the vertical pump system intake (61). Accordingly, the intermediate bypass flow (B) through the fluidseeker, which may be mixed-phase, is isolated from the high-quality liquid flow through the recovery flow tube. This isolation ensures the liquids which have separated from gas by retention time and separation in the annulus are not mixed with the lower quality, higher velocity multi-phase fluids travelling through the separator body.

Fluids in the annular external passage (C) will generally comprise mixed liquids and gases, and the gases may have a higher velocity. This flow originates in the horizontal section and moves along in the annulus between the liner and the production tubing. Slug flow in this annulus is possible but not desirable. Gas pressure may drive liquid slugs and breakthrough in parts so that gas and liquid slugs alternate. In one embodiment, the wavebreaker (9) narrows the annular space and has an external profile which modulates fluid flow around the wavebreaker. As shown in FIG. 4, when the mixed phase in the external passage (C) encounters the wavebreaker, gas in the free state is permitted to flow around the wavebreaker on the top side of the wellbore annulus. The advancement of the liquid phase slows considerably at the wavebreaker, and liquids are encouraged to enter the system below the wavebreaker through the primary intake (11) slots/screen. As a result, gas/liquid separation is encouraged, and the liquids accumulate in the lower portion of the annulus, while gas flow continues above it.

Figure 5B:
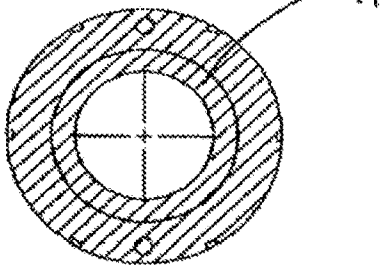
FIG. 5B is a transverse cross-section along line B-B in FIG. 5A.
Figure 5A:
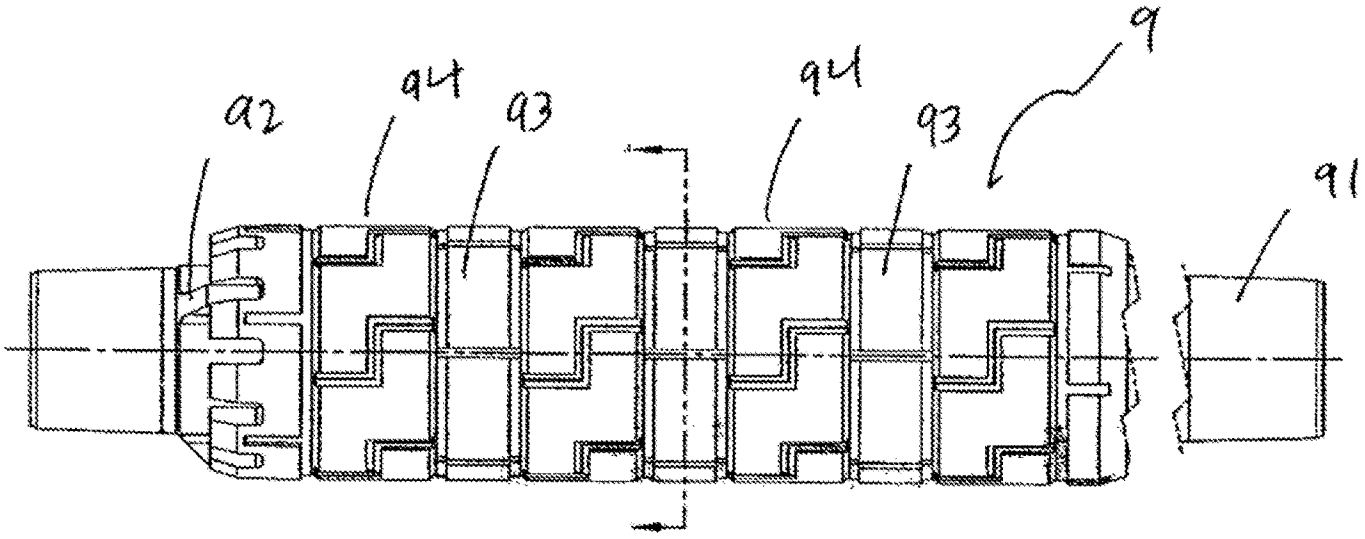
FIG. 5A shows a wavebreaker device.
Figure 5C:
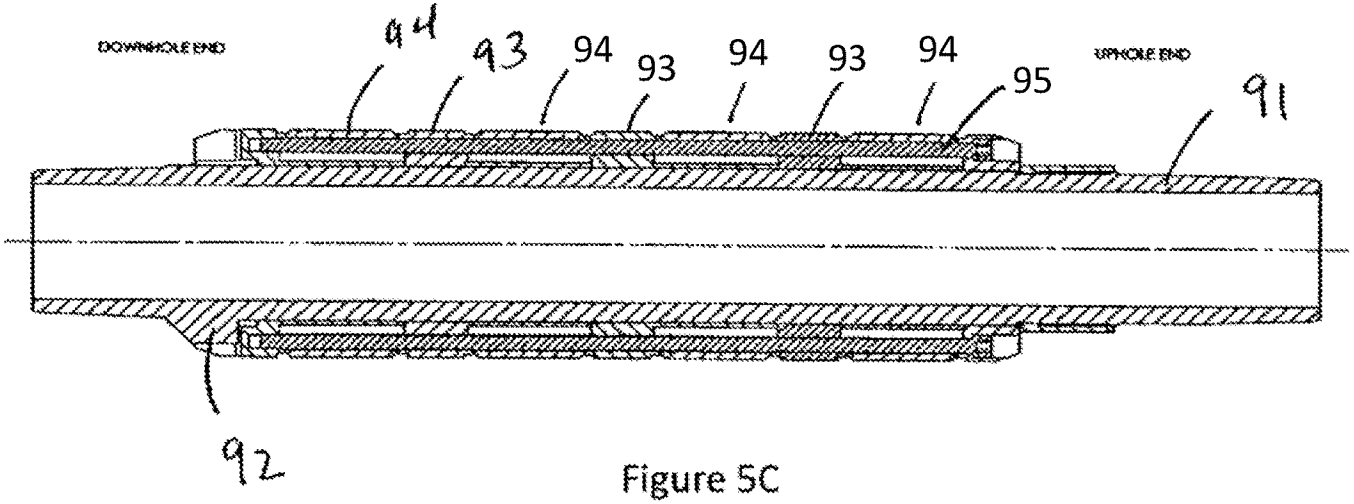
FIG. 5C is a longitudinal cross-section of FIG. 5A.

As shown in FIG. 5, some embodiments of the wavebreaker are comprised of a central, tubular mandrel (91) with outwardly protruding lugs (92) on the up-hole end. The lugs engage with the castellated slots in the wavebreaker block housing (93) to set the rotational position of the block assembly (94) and permit alignment of the assembly with a capillary line which, when required, transits through the wavebreaker assembly.

Disengagement of the nut on the bottom end of the wavebreaker tubular mandrel permits rotation of the block assembly in order to align an opening (99) for capillary lines with the location of the capillary lines while deploying the system into a subject wellbore. This opening can be seen in the alternate embodiment drawings of the wavebreaker in FIG. 6.

In some embodiments, the block assembly is a single body of a material with flexural strength sufficient to permit engagement with the casing wall to energize (compress) the assembly. In such an embodiment the body is rotatably engaged with the wavebreaker mandrel with a pre-determined opening to permit passage of capillary lines around the wavebreaker assembly.

In some embodiment, the block assembly comprises multiple housings containing the blocks which are bolted together with a plurality of elongate bolts (95). In other embodiments, the wavebreaker blocks are oriented lengthwise, spanning the length of the assembly and are contained by an upper and lower housing also bolted together by a plurality of elongate bolts.

FIG. 7 depicts an exemplary schematic configuration of a fluid flow management system and the multi-phase flow passage through the system. Fluids from the reservoir enter the intake (11) on the downhole distal end of the system. Fluid slugging movement in the horizontal wellbore is dissipated by the wavebreaker (9), while gas already in a free state in this region is permitted to travel around the wavebreaker (9). Liquids and mixed flow are then encouraged to enter the separator body by way of the perforated/screened intake (11). The liquid flow then passes through the center of the centralizer (10) and wavebreaker (9), through the fluidseeker (8) bypass passages, through the separator body (7) which comprises the annular space surrounding the recovery flow tube, and exiting to the annulus through the body perforations. This is the passage way for the higher velocity mixed phase flow. While this flow is higher in velocity, the separator body may be configured to encourage laminar flow and prevent turbulent mixing. The flow exits to the annulus where the phases undergo retention time and exposure to the annular area to allow for phase separation under the influence of gravity. Sufficient retention length may be designed into the system between the wavebreaker (9) and the top perforations in the separator (7) into the annulus to induce calmness in the flow, increased surface area of the resident fluid and allow for the separation of the phases. The highest quality fluid then accumulates on the low side of the horizontal wellbore in the calm region uphole of the wavebreaker and in the vicinity of the fluidseeker inlet. With the calmness induced in this region, the fluidseeker inlet seeks the lowest position in the wellbore and is thus submerged in liquid. Consequently, it can supply the highest quality of liquid via the isolated recovery flow into the tubing string and ultimately the pumping system intake.

Clutch

A clutch assembly (14) is required in the context of deploying downhole devices, or downhole horizontal pumps along the wellbore with common activation strings (99) whether it be capillary lines for a fluid system or electrical lines for an electrically powered pumping system or smaller gauge wire for instrumentation systems and data collection. All of these variations have a common foundational challenge involved in consistently and reliably making connections with the external lines at each of the deployable device locations. Where the tubing string is made up with a specified connection torque and not an aligned rotational position, the angular position of the capillary lines (99) with respect to the tubing below the pump and the rotational position of the lines exiting the local pump may not necessarily be in alignment. Therefore, in some embodiments, a rotatable and sealed tubing deployed clutch (14) allows for installation of multiple pump deployments with capillary lines and electrical conduits.

In such conditions the rotatable, sealed tubing deployed clutch permits conditions whereby the tubing and operational device may be temporarily disconnected in a rotatable sense to allow the external activation conduits to be aligned with the same in the device. Then the clutch may be re-engaged and locked and the subsequent operations continued.

In some embodiments, the rotatable, sealed tubing deployed clutch is comprised of an indexing mandrel (140) disposed within and sealingly engaged with the clutch body (141). The mandrel and the clutch body are affixed to one another in a rotational sense with the engagement of the castellations (142) located on the outer surface of the indexing mandrel and on the proximal end face of the clutch body. The engagement of the castellations is controllable by the axial position of the lock housing (143), surrounding the castellations (142) disposed between the two bodies.

In the fully locked position, as shown in FIG. 8A, externally applied torque is transmitted by the castellations (142) between the indexing mandrel (140) and the clutch body (141). FIG. 8B shows the locked state, where the lock housing (903) is removed for visualization purposes only, showing the castellations (142). In the same manner externally applied tension is transmitted through the device by way of the locking segments (144) disposed radially between the outer surface of the indexing mandrel and the distal end face of the lock body and finally through the internal threads of the lock body which are threadingly engaged and spanning the castellations between the lock body external threads and the clutch body external threads.

FIG. 8C shows the clutch where the lock housing (143) has been disengaged, but with the castellations (142) still engaged. The mandrel and the clutch body may then be pulled apart, disengaging the castellations, as shown in FIGS. 8D and 8E. In this disengaged state, the mandrel and clutch may be freely rotated relative to each other, in order to align the capillary lines and electrical lines.

Reliable re-engagement of the castellations after the new rotational position has been established is accomplished by way of the indexing alignment slots (145). The slots are transversely aligned with the male castellations of the clutch body and the corresponding female castellations on the indexing mandrel. Therefore, with the castellations being enclosed by the lock housing during normal operations the re-alignment and re-engagement of the castellations is accomplished by visually and/or physically aligning the indexing alignment slots on the distal and proximal ends of the clutch assembly. Once said slots are in axial alignment, the clutch assembly may be closed and locked in the reverse operation which caused the castellations to be dis-engaged initially.

Sealing engagement of the two main bodies is permitted by the seal assembly (146) radially disposed on the outer surface at the distal end of the indexing mandrel. Sealing engagement and seal movement is limited by way of the limit detent ring (147) expanding into the pre-disposed internal groove of the clutch body as the indexing mandrel is permitted to travel towards the proximal end of the same.

Integration with Horizontal Pumping System

The horizontal section downhole from the fluid flow management system described herein may comprise a pumping system such as that described in co-owned U.S. Pat. No. 9,863,414 B2, or the co-pending Patent Cooperation Treaty Application entitled "Horizontal Wellbore Pump System and Method", filed on Mar. 12, 2019, the entire contents of both which are incorporated herein by reference, where permitted. It is intended that the liquid output of each horizontal pump is directed into the central fluid passage (A), which will have a direct path towards the vertical lift pump.

Accordingly, examples of the fluid flow management system described herein may create some isolation between the liquid and gas flow regimes, where the liquid flow is directed to the vertical pump intake, while gases may accumulate in the annulus.

Interpretation

The description of the present invention has been presented for purposes of illustration and description, but it is not intended to be exhaustive or limited to the invention in the form disclosed. Many modifications and variations will be apparent to those of ordinary skill in the art without departing from the scope and spirit of the invention. Embodiments were chosen and described in order to best explain the principles of the invention and the practical application, and to enable others of ordinary skill in the art to understand the invention for various embodiments with various modifications as are suited to the particular use contemplated. To the extent that the following description is of a specific embodiment or a particular use of the invention, it is intended to be illustrative only, and not limiting of the claimed invention.

The corresponding structures, materials, acts, and equivalents of all means or steps plus function elements in the claims appended to this specification are intended to include any structure, material, or act for performing the function in combination with other claimed elements as specifically claimed.

References in the specification to "one embodiment", "an embodiment", etc., indicate that the embodiment described may include a particular aspect, feature, structure, or characteristic, but not every embodiment necessarily includes that aspect, feature, structure, or characteristic. Moreover, such phrases may, but do not necessarily, refer to the same embodiment referred to in other portions of the specification. Further, when a particular aspect, feature, structure, or characteristic is described in connection with an embodiment, it is within the knowledge of one skilled in the art to combine, affect or connect such aspect, feature, structure, or characteristic with other embodiments, whether or not such connection or combination is explicitly described. In other words, any element or feature may be combined with any other element or feature in different embodiments, unless there is an obvious or inherent incompatibility between the two, or it is specifically excluded.

It is further noted that the claims may be drafted to exclude any optional element. As such, this statement is intended to serve as antecedent basis for the use of exclusive terminology, such as "solely," "only," and the like, in connection with the recitation of claim elements or use of a "negative" limitation. The terms "preferably," "preferred," "prefer," "optionally," "may," and similar terms are used to indicate that an item, condition or step being referred to is an optional (not required) feature of the invention.

The singular forms "a," "an," and "the" include the plural reference unless the context clearly dictates otherwise. The term "and/or" means any one of the items, any combination of the items, or all of the items with which this term is associated.

As will be understood by one skilled in the art, for any and all purposes, particularly in terms of providing a written description, all ranges recited herein also encompass any and all possible sub-ranges and combinations of sub-ranges thereof, as well as the individual values making up the range, particularly integer values. A recited range (e.g., weight percents or carbon groups) includes each specific value, integer, decimal, or identity within the range. Any listed range can be easily recognized as sufficiently describing and enabling the same range being broken down into at least equal halves, thirds, quarters, fifths, or tenths. As a non-limiting example, any range discussed herein can be readily broken down into a lower third, middle third and upper third, etc.

As will also be understood by one skilled in the art, all ranges described herein, and all language such as "up to", "at least", "greater than", "less than", "more than", "or more", and the like, include the number(s) recited and such terms refer to ranges that can be subsequently broken down into sub-ranges as discussed above.

The invention claimed is:

1. A flow management and separation system for a wellbore having a horizontal section, vertical section and intermediate build section, a production tubing, and an annulus surrounding the production tubing, the system comprising:

(a) an intake to an intake flow passage, to receive produced fluids from the reservoir;

(b) a wavebreaker arranged in the production tubing and providing a narrowed annular cross-section than the annulus, wherein the intake flow passage extends through the wavebreaker; and (c) a fluidseeker comprising a rotatable inlet extension having a weighted keel, in fluid communication with a central passage, and an internal bypass passage in fluid communication with the intake flow passage.

2. The system of claim 1 further comprising a separator having a perforated housing and an internal recovery flow tube defining a separation space between them, wherein the recovery flow tube receives fluid from the central passage of the fluidseeker, and the separation space receives fluid from the bypass passage of the fluid seeker.

3. The system of claim 1 disposed adjacent a primary vertical lift device disposed in the intermediate build section or a heel segment of the horizontal section, the device having an intake connected to the recovery flow tube, and an outlet into the production tubing.

4. The system of claim 3 wherein the primary vertical lift comprises a reciprocating rod pump, a diaphragm pump, an electric submersible pump, a hydraulic submersible pump, a jet pump, a pneumatic drive pump, a gas lift pump, a gear pump, a progressive cavity pump, a vane pump, gas lift mandrels, plunger lift or combinations thereof.

5. The system of claim 4 wherein the primary artificial lift comprises a reciprocating rod pump.

6. The system of claim 5 wherein the reciprocating rod pump is a high angle, insert type rod pump, landed immediately below the build section of the wellbore.

7. The system of claim 1 wherein the wavebreaker is a single body which is affixed to the mandrel and constructed of a material with flexural strength sufficient to permit engagement with the wellbore casing to energize the device in application.

8. The system of claim 7 wherein the single body wavebreaker is equipped with a capillary slot through which at least one capillary line and/or at least one electrical conduit bypasses the wavebreaker assembly.

9. The system of claim 1 wherein the wavebreaker comprises spring loaded blocks, biased radially outward to be in contact with a casing or liner, the blocks defining bypass grooves therebetween.

10. The system of claim 9 wherein the wavebreaker comprises removable blocks to allow passage for at least one capillary lines and/or at least one electrical conduit.

11. The system of claim 10 wherein the at least one capillary line delivers treatment chemicals, or the at least one electrical conduit comprises at least one wire connected to a downhole sensor and surface read out data acquisition equipment.

12. The system of claim 1 wherein the fluid flow management system comprises a clutch on the distal end of the assembly for aligning an open section of the wavebreaker with the path of at least one external capillary line and/or electrical conduit.

13. The system of claim 1, wherein the fluidseeker is positioned uphole of the wavebreaker.

14. The system of claim 1, wherein the wavebreaker is positioned between the fluidseeker and the intake.

15. The system of claim 1, wherein the wellbore further comprises a casing, and wherein an external profile of the wavebreaker contacts the casing without forming a seal.

16. The system of claim 1, wherein an external profile of the wavebreaker de-energizes fluid slugs in the annulus around the wavebreaker.

17. The system of claim 1, wherein the inlet portion is downhole from the fluid seeker.

18. The system of claim 1, wherein the wavebreaker has an external profile that modulates fluid flow in the annulus around the wavebreaker.

19. A method of producing a well having a vertical, build and horizontal sections, and comprising a production tubing and a lining, casing or reservoir face defining an annulus, the method comprising:

a. landing a primary artificial lift system with a fluid flow management system in the build section or a heel portion of the horizontal section, the fluid flow management system including a down-hole inlet, a separator uphole of the inlet and operative to calm annular mixed phase flow and provide retention time to encourage liquid dropout to a lower section of the annulus, and a rotatable gravity-directed inlet extension arranged between the inlet and the separator and oriented in the lower section of the annulus, wherein the inlet extension is connected to an intake for the primary artificial lift system; and b. operating the primary artificial lift system to lift fluids through the inlet extension.

20. The method of claim 19 further comprising the step of collecting wellbore data from downhole locations and processing the data to (a) control operation of the primary artificial lift and/or the fluid flow management system, (b) plan or configure a horizontal pumping system, and/or (c) plan a stimulation fracturing scheme.

* * * * *